US005588820A

United States Patent [19]

Hill et al.

[11] Patent Number: 5,588,820

[45] Date of Patent: Dec. 31, 1996

[54] SCROLL COMPRESSOR HAVING AN AXIAL COMPLIANCE PRESSURE CHAMBER

[75] Inventors: Joe T. Hill, Bristol, Va.; Gene M. Fields; John R. Williams, both of Bristol, Tenn.

[73] Assignee: Bristol Compressors, Inc., Bristol, Va.

[21] Appl. No.: 391,733

[22] Filed: Feb. 21, 1995

[51] Int. Cl.[6] ..... F04C 18/04; F04C 27/00

[52] U.S. Cl. ..... 418/55.4; 418/55.5; 418/57

[58] Field of Search ..... 418/55.2, 55.4, 418/55.5, 57

[56] References Cited

U.S. PATENT DOCUMENTS

| | | | |
|---|---|---|---|
| 3,600,114 | 8/1971 | Dvorak et al. | 418/55.5 |
| 4,645,437 | 2/1987 | Sakashita et al. | 418/55.5 |
| 5,129,798 | 7/1992 | Crum et al. | 418/55.4 |

FOREIGN PATENT DOCUMENTS

| | | | |
|---|---|---|---|
| 60-224989 | 11/1985 | Japan | 418/55.4 |
| 4-86391 | 3/1992 | Japan | 418/55.5 |
| 5149267 | 6/1993 | Japan | 418/55.5 |

*Primary Examiner*—John J. Vrablik

[57] ABSTRACT

A scroll compressor having a housing, a fixed scroll stationary on said housing, an orbiting scroll nested with the fixed scroll and being mounted on the eccentric of the compressor crankshaft for orbital motion about the longitudinal axis of the compressor, the base of the orbiting scroll having an annular groove formed in the outside or low pressure side thereof, a passage formed through the base of the orbiting scroll and placing the groove in fluid communication with an intermediate section of the pressure continuum for providing an axial compliance force against the base of the orbiting scroll and urging the wrap tips thereof into sealing engagement with the adjacent base of the fixed scroll, an annular seal positioned in the groove and having an annular web provided with a substantially planar contact side positioned in sliding, sealing contact with a sealing surface of housing and having annular elastomeric sealing components slidingly sealed against the walls of the groove to provide an axial compliance pressure chamber which is sealed from ambient pressures.

5 Claims, 1 Drawing Sheet

SCROLL COMPRESSOR HAVING AN AXIAL COMPLIANCE PRESSURE CHAMBER

FIELD OF INVENTION

This invention concerns scroll compressors such as employed in air conditioning and refrigeration systems, and particularly concerns novel structure of a combination of elements including the scrolls themselves, their axial compliance mechanism, the mounting structure for the orbiting scroll, and the axial compliance sealing means.

BACKGROUND OF THE INVENTION

In scroll compressors it is necessary or at least highly desirable to provide an axial compliance mechanism which effects proper sealing of the wrap tips against the adjacent scroll base even though pressures of several hundred psi are typically developed in the pressure continuum, i.e., the compression pockets which are continuously formed, compressed, discharged and reformed between the scrolls. This mechanism, most often, comprises an axial compliance pressure chamber by which forces are exerted against the axially outer surface of the base of one of the scrolls which significantly counteract the forces which tend to axially separate the scrolls. One of the greatest difficulties encountered with the use of such a chamber is the problem of maintaining its seal during axial compliance movement of the scroll selected and mounted for such movement.

Also, in scroll compressors, the high pressure pockets of the pressure continuum are typically responsible for imparting strong forces, i.e., tangential, radial, or lateral against the wrap of the orbiting scroll which tend to tip the scroll on its longitudinal axis. This tipping action is often exacerbated in compressors wherein the orbiting scroll is the one set up for axial compliance motion since greater clearances of the drive shaft eccentric and the bearing means on the scroll, e.g., when employing radial compliance structures, can lead to increased looseness in the system and greater allowance for tipping of the scroll on its axis. This tipping usually results in loss of sealing between the wrap walls and between their tips and the juxtaposed base of the other scroll, and thus a loss of efficiency, as well as excessive wear contact of the orbiting scroll with the stationary scroll. Also, increased axial compliance force becomes necessary to compensate for the non-planar mating of the wrap tips and juxtaposed scroll base, and proper continued sealing of the axial compliance pressure chamber is thus compromised. The aforementioned novel structure of the present invention dramatically diminishes the tendency of the orbiting scroll to so tip while affording a greatly simplified and economical structure to certain aspects of the compressor, particularly the pressure chamber seal means, as will hereinafter become evident.

PRIOR ART

Heretofore, scroll compressors in which the orbiting scroll is mounted on a permanent or fixed portion of the compressor, typically the housing for axial compliance movement usually involves fairly complex sealing means for the axial compliance pressure chamber as shown, e.g., in U.S. Pat. No. 4,938,669, and in other types and variations of sealing means for various compressor constructions such as shown in U.S. Pat. Nos.: 5,129,798; 4,877,382; 5,102,316; 5,088,906; 5,085,565; 5,082,432; 4,892,469; 4,600,369; 3,874,827; 4,767,293; and 5,295,813, the disclosures of which regarding the known and generally employed construction of compressor shell, motor, Oldham coupling, aspects of scroll construction and manufacture auxiliary to or other than that of the present invention, scroll drive structure such as eccentric mounting bushing and radial compliance devices, and the like, are hereby incorporated herein by reference, as being useful in manufacturing and/or use of the present invention.

Objects, therefore, of the present invention are: to provide novel scroll and seal construction which, in addition to enhancing scroll wrap tip sealing, also substantially reduces the development of net or unbalanced compression forces which normally would cause tipping of the orbiting scroll, i.e., across its longitudinal axis and which would necessitate the application of higher axial compliance forces; to provide such seal construction which markedly increases seal life and minimizes the degree of scroll machining and modification necessary for utilizing the present invention; to provide such seal construction which essentially maintains the compression efficiency of the scrolls during axially compliant movement; and to provide such scroll construction which is adaptable to a wide variety of scroll compressor constructions.

BRIEF SUMMARY OF THE INVENTION

These and further objects hereinafter appearing have been attained in accordance with the present invention which, in a preferred embodiment is defined as a compressor comprising a housing means, a non-orbiting scroll fixed in position angularly, radially and axially on said housing means, an orbiting scroll nested with said non-orbiting scroll, each of said scrolls having base means formed with a free side and a pressure side and a wrap extending outwardly from said pressure side, said orbiting scroll being mounted on the eccentric of the compressor crankshaft for orbital motion about the longitudinal axis of the compressor to produce a pressure continuum between the wraps and bases of said scroll, the free side of said base of said orbiting scroll having an overall substantially annular planar configuration with annular groove means provided therein and formed with side and top wall means and being juxtaposed a substantially annular planar sealing surface formed on said housing means, passage means formed through said base of said orbiting scroll and placing said groove means in fluid communication with an intermediate section of said pressure continuum for providing an axial compliance force against said top wall means of said groove means for urging said orbiting scroll axially toward said non-orbiting scroll to bring the wrap tips of each said scroll toward sealing engagement with the adjacent base of the other scroll, annular seal means in said groove means having an annular web section provided with a substantially planar contact side positioned in sliding, sealing contact with said sealing surface of said housing means, and further having annular, elastomeric, side sealing components slidingly sealed against the side wall means of said groove means to provide axial compliance pressure chamber means which is sealed from ambient pressures.

In certain preferred embodiments:

(a) said contact side of said web means is formed of a material selected from the group consisting of metal, ceramic, polytetrafluoroethylene, polyamide, polyimide, polyester, polycarbonate, polyurethane, or poly (amide-imide);

(b) said seal means comprises annular ring means being axially slidably mounted in said groove means and having annular shoulder means on its inner and outer peripheries, and annular, elastomeric seal components sealingly contacting and being positioned on said shoulder means and sealingly contacting the side walls of said groove means to provide said axial compliance pressure chamber means; and (c) annular recess means is formed in a radially central and annular portion of said contact side of said seal means for reducing the contact area thereof, and aperture means is provided through said web means and placing said recess means in fluid communication with said chamber means for reducing the total force which is exerted on said web means and which urges it against said sealing surface on said housing means.

BRIEF DESCRIPTION OF THE DRAWINGS

The invention will be further understood from the drawings and description herein of certain preferred embodiments, wherein.

DETAILED DESCRIPTION OF THE DRAWINGS

Figure 1:
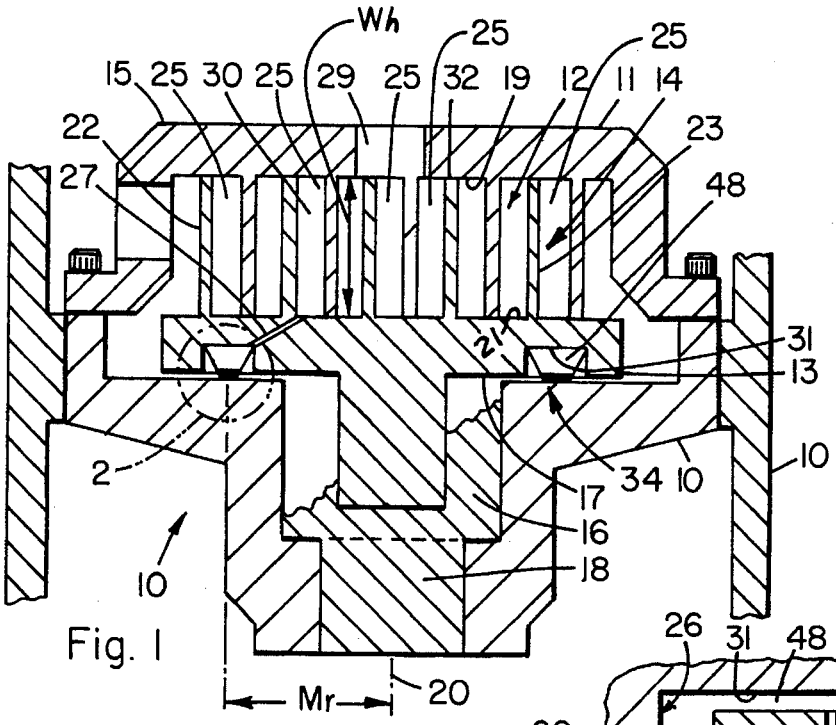
FIG. 1 is longitudinal cross-sectional view of the scroll area of a compressor embodying the present invention, with only portions of the outside wall portions of the compressor housing shown.

Referring to the drawings and with particular reference to the claims herein, the present scroll compressor comprises a housing means 10, a non-orbiting scroll 12 fixed in position angularly, radially and axially on said housing means, an orbiting scroll 14 nested with said non-orbiting scroll, said scrolls having base means 11 and 13 respectively formed with a free side 15 and 17 respectively and a pressure side 19 and 21 respectively and a wrap 22 and 23 respectively extending outwardly from said pressure sides, a discharge port 29 is provided three base means 11, said orbiting scroll being mounted on the eccentric 16 of the compressor crankshaft 18 for orbital motion about the longitudinal axis 20 of the compressor to produce a pressure continuum generally designated 25 between the wraps and bases of said scroll, the free side 17 of said base means of said orbiting scroll having an overall substantially annular planar configuration with annular groove means 26 provided therein and formed with sides 44, 46 and top wall means 31 and being juxtaposed a substantially annular planar sealing surface 24 formed on said housing means, passage means 27 formed through said base means of said orbiting scroll and placing said groove means in fluid communication with an intermediate pressure in a section such as 30 of said pressure continuum for providing an axial compliance force against said top wall means 31 of said groove means for urging said orbiting scroll axially toward said non-orbiting scroll and thereby moving the wrap tips of each said scroll toward sealing engagement with the adjacent base means of the other scroll, annular seal means 34 in said groove means having an annular web section 36 provided with a substantially planar contact side generally designated 38 positioned in sliding, sealing contact with said sealing surface 24 of said housing means, and further having annular, elastomeric, side sealing components 40, 42 slidingly sealed against the side walls 44, 46 respectively of said groove means to provide axial compliance pressure chamber means 48 which is sealed from ambient pressures.

It is noted that the intermediate pressure 30 can be selected as desired by placement of passage 27, or any number of such passages, thru the scroll base. The passage or passages placement may be such that the tip of the non-orbiting scroll wrap will block or partially block any particular passage during the orbit cycle and thereby vary the axial compliance force exerted on the orbiting scroll in a predesigned manner.

Figure 2:
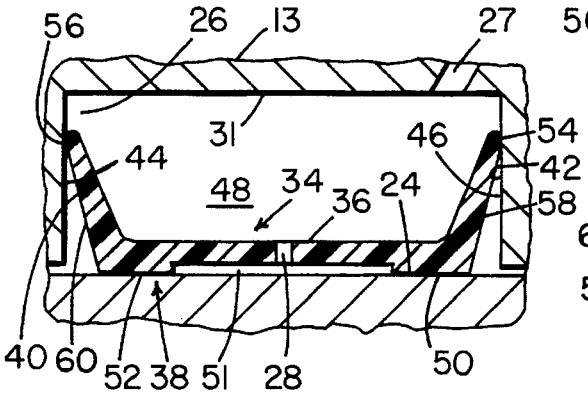
FIG. 2 is an enlarged view of the encircled seal area 2 in FIG. 1.

In a preferred embodiment of the seal means shown in FIG. 2, the planar contact side 38 of the seal web is formed with an annular recess 51 and is in fluid pressure communication with pressure chamber 48 through aperture or passage means 28. This arrangement will reduce the thrust force of the contact side of the web on the sealing surface and thus reduce the wear of these surfaces, but still produce the same lifting force against the orbiting scroll base to move it off of the housing means for providing axial compliance.

Figure 3:
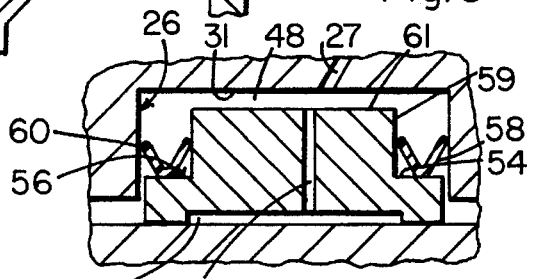
FIGS. 3 and 4 are variations of the seal means structure of FIGS. 1 and 2, shown in cross-section.
Figure 4:
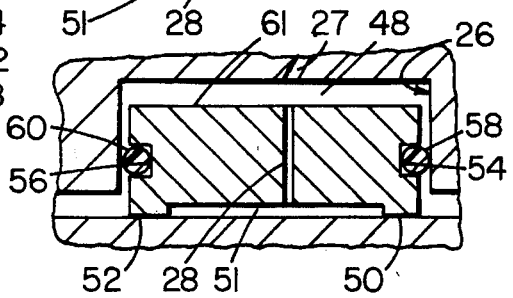

The axial compliance seal means embodiments of FIG. 3 and 4 each comprises an annular ring means 61 which is axially slidably mounted in groove means 26, annular shoulder means generally designated 54, 56 respectively on the inner and outer peripheries of said ring means, and annular, elastomeric seal elements 58, 60 respectively sealingly contacting and being positioned by said shoulder means and sealingly contacting the walls of said groove means to provide said pressure chamber means 48. A recess such as 51 and aperture 28 may also be provided in these embodiments as aforedescribed.

In all embodiments described herein, the contact side 38 of said web means is formed preferably of a material selected from the group consisting of brass or other long wearing metal, ceramic, polytetrafluoroethylene, polyamide, polyimide, polyester, polycarbonate, polyurethane, or poly (amide-imide). In this regard, this contact side, or any portions thereof, in being recessed as at 51 will provide one or more annular segments such as 50, 52 which may consist of any suitable material such as indicated above bonded to the elastomeric web section 36 or the intermediate portions 58, 60 respectively of sealing components 42, 40. Likewise the actual contact edges 54, 56 of said components may be formed of any of said materials.

Figure 5:
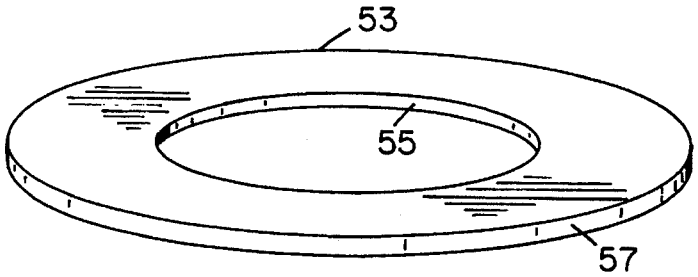
FIG. 5 is an isometric view of a flip-seal useful with the present invention.

The seal may comprise a preformed, generally V-shaped element or an O-ring as shown in FIGS. 3 and 4, or it may be in the form of a normally flat, washer shaped elastomeric or leather flip seal 53 as shown in flat form in FIG. 5. This type of seal, when its inner periphery 55 is stretched over a tight fitting mandrel surface such as 59, will cause its outer periphery 57 to collapse toward said inner periphery and assume the general form of the seals shown in FIG. 3.

Referring further to FIG. 1, it is seen that the annular seal means 34 is sufficiently large in diameter as to cause base means 13 of the orbiting scroll to remain essentially planar during its axial compliance movement since the large moment of axial force provided by said large diameter effectively counterbalances or at least greatly diminishes the tipping force moment typically applied laterally to the orbiting scroll. More specifically, it is preferred to locate the median radius of groove means 26 and seal means 34 on the scroll base such that the ratio of said median radius (Mr) to the wrap height (Wh) is from about 0.8 to about 2.0, and most preferably from about 1.1 to about 1.5. It is noted however, that any particular ratio of Mr/Wh selected will be determined, in large measure, by the wrap height and other dimensions involved or well as the operating pressures and the like of the particular compressor concerned.

The invention has been described in detail with particular reference to preferred embodiments thereof, but it will be understood that variations and modification will be effected within the spirit and scope of the invention.

We claim:

1. A scroll compressor having a housing means, a non-orbiting scroll fixed in position angularly, radially and axially on the compressor housing means, an orbiting scroll nested with said non-orbiting scroll, each of said scrolls having base means formed with a free side and a pressure side and a wrap extending outwardly from said pressure side, said orbiting scroll being mounted on an eccentric of a compressor crankshaft for orbital motion about the longitudinal axis of the compressor to produce a pressure continuum between the wraps and base means of said scrolls, the free side of said base means of said orbiting scroll having an overall substantially annular planar configuration with annular groove means provided therein and formed with side and top wall means and being juxtaposed a substantially annular planar sealing surface formed on said housing means, passage means formed through said base means of said orbiting scroll and placing said groove means in fluid communication with an intermediate pressure section of said pressure continuum for providing an axial compliance force against said top wall means of said groove means for urging said orbiting scroll axially toward said non-orbiting scroll to bring the wrap tips of each said scroll toward sealing engagement with the adjacent base means of the other scroll, annular seal means in said groove means having an annular web means provided with a substantially planar contact side positioned in sliding, sealing contact with said sealing surface of said housing means, and further having annular, elastomeric, side sealing components slidingly sealed against the side wall means of said groove means to provide axial compliance pressure chamber means which is sealed from ambient pressures, wherein said seal means comprises annular ring means which is axially slidably mounted in said groove means, annular shoulder means on the inner and outer peripheries of said ring means, and annular, elastomeric seal components sealingly contacting and being supported on said shoulder means and sealingly contacting the walls of said groove means to provide said axial compliance pressure chamber means, and wherein annular recess means is formed in a radially central portion of said contact side of said web means for reducing the contact area thereof, and aperture means is provided through said web means and placing said recess means in fluid communication with said chamber means for reducing the total force which is exerted on said web means and which urges it against said sealing surface on said housing means.

2. The compressor of claim 1 wherein said contact side of said web means is formed of a material selected from the group consisting of metal, ceramic, polytetrafluoroethylene, polyamide, polyimide, polyester, polycarbonate, polyurethane, or poly (amide-imide).

3. The compressor of claim 1 wherein the ratio of the median radius of said seal means to the orbiting scroll wrap height is from about 0.8 to about 2.0.

4. The compressor of claim 1 wherein said seal components comprise an annular, generally V-shaped elastomeric ring member.

5. The compressor of claim 1 wherein said seal components comprise an elastomeric O-ring.

* * * * *